US005803029A

United States Patent [19]

Yoshihara et al.

[11] Patent Number: 5,803,029

[45] Date of Patent: Sep. 8, 1998

[54] VALVE PERFORMANCE CONTROLLER FOR INTERNAL COMBUSTION ENGINE

[75] Inventors: Yuji Yoshihara, Toyota; Hiroyuki Kawase, Okazaki; Yuichi Sakaguchi, Nagoya; Kouichi Shimizu; Hiromasa Suzuki, both of Toyota, all of Japan

[73] Assignee: Toyota Jidosha Kabushiki Kaisha, Toyota, Japan

[21] Appl. No.: 927,224

[22] Filed: Sep. 10, 1997

[30] Foreign Application Priority Data

Sep. 11, 1996 [JP] Japan ..... 8-240240

[51] Int. Cl.[6] ..... F02D 13/02; F01L 1/34; F01L 13/00

[52] U.S. Cl. ..... 123/90.16; 123/90.17; 123/90.15

[58] Field of Search ..... 123/90.12, 90.15, 123/90.16, 90.17, 90.22, 90.31, 90.39

[56] References Cited

U.S. PATENT DOCUMENTS 5,031,583 7/1991 Konno ..... 123/90.16

5,497,737 3/1996 Nakamura ..... 123/90.16

FOREIGN PATENT DOCUMENTS 8-14015A 1/1996 Japan .

8-28219A 1/1996 Japan .

8-49514A 2/1996 Japan .

*Primary Examiner*—Weilun Lo

*Attorney, Agent, or Firm*—Kenyon & Kenyon

[57] ABSTRACT

There is disclosed a valve performance controller for an internal combustion engine. A camshaft is provided with a plurality of cams having different cam profiles. Changeover of the cams is performed through operation of a valve lift control mechanism. Also, a valve timing control mechanism is provided on the camshaft. The valve timing mechanism has a pulley, which is connected to a crankshaft of the engine via a timing belt. The pulley is connected to the camshaft via a ring gear. Through movement of the ring gear along the axis of the camshaft, the relative rotational phase between the pulley and the camshaft is changed. At least during cam changeover operation, oil is charged and retained within the hydraulic chamber located on both sides of the ring gear in the moving direction thereof. This structure reduces an impact which acts on the timing belt upon changeover of the cams.

12 Claims, 5 Drawing Sheets

VALVE PERFORMANCE CONTROLLER FOR INTERNAL COMBUSTION ENGINE

BACKGROUND OF THE INVENTION

1. Field of the Invention

The present invention relates to a valve performance controller for varying the valve timing and the valve lift in an internal combustion engine.

2. Description of the Related Art

In Japanese Unexamined Patent Publication No. 8-49514, a valve apparatus includes a camshaft, a valve timing control mechanism, and a valve lift control mechanism. The camshaft is connected to the crankshaft of an internal combustion engine via a timing belt. The camshaft is provided with a plurality of cams of different shapes for actuating valves. The valve timing control mechanism causes the camshaft to lead or lag the crankshaft to thereby vary the timing of actuating valves. The valve lift control mechanism selects a cam to actuate valves, thereby changing the lift of the valves.

In the conventional valve apparatus described above, the shapes of the cams and roughness of the contact surfaces of the cams vary. Thus, upon changing the active cam, the driving torque for rotating the camshaft fluctuates significantly, so that a large impact derived from the torque fluctuation acts on the timing belt. As a result, deterioration of the timing belt accelerates, resulting in a shorter replacement cycle for the timing belt.

SUMMARY OF THE INVENTION

The present invention has been accomplished to solve the above-mentioned problems, and an object of the present invention is to reduce the impact acting on a transmission device, such as a timing belt, upon changeover of cams.

To achieve the above object, the present invention provides an apparatus for controlling valve performance in an engine. The engine has a combustion chamber connected with an air intake passage and an air exhaust passage, an intake valve located in the intake passage to control airflow supplied to the combustion chamber from the intake passage, and an exhaust valve located in the exhaust passage to control exhaust airflow to the exhaust passage from the combustion chamber. Each of the valves is controlled to adjust airflow passing therethrough with a variable valve lift amount and a variable valve timing. A camshaft is provided with a plurality of cams of different shapes for actuating at least one of the valves. A first mechanism selects at lest one cam for actuating the actuated valve to alter a lift amount of the actuated valve. A second mechanism controls the valve timing. The second mechanism is provided on the camshaft. The second mechanism has a rotary member, a movable member, and first and second hydraulic chambers. The movable member couples the rotary member with the camshaft. The movable member moves to change the relative rotational phase between the rotary member and the camshaft. The first and second hydraulic chambers are provided respectively on opposite sides of the movable member. The chambers control movement of the movable member with hydraulic pressure. A transmission device transmits torque from the engine to the rotary member. Altering means alters the hydraulic pressure in the first and second chambers. The altering means selectively supplies hydraulic fluid to and drains hydraulic fluid from the first and second hydraulic chambers. Controlling means controls the altering means to charge and retain hydraulic fluid in the chambers during changing of the operative cam by said first mechanism.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENT

A preferred embodiment of the present invention will now be described with reference to FIGS. 1 to 5.

Figure 5:
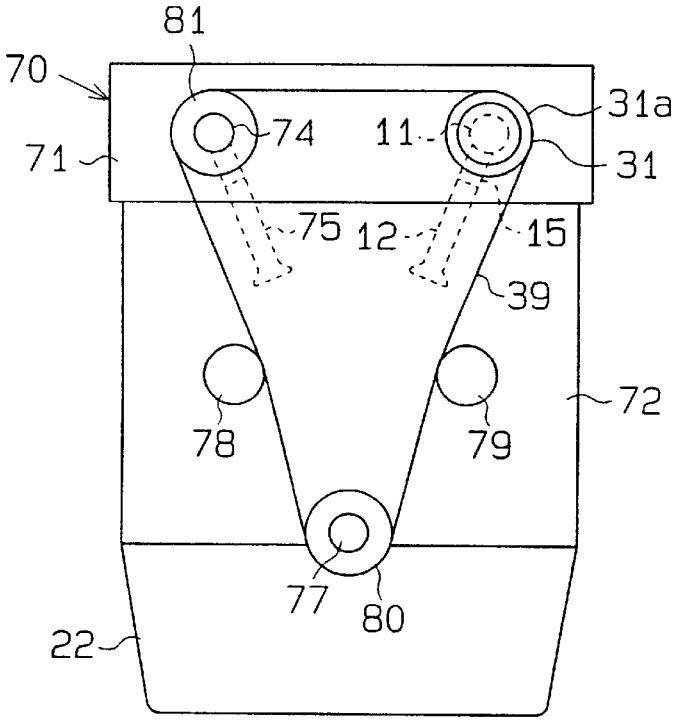
FIG. 5 is a diagrammatic front view showing an engine.

An engine 70 having a valve train that includes a valve timing control mechanism 31 and a valve lift control mechanism 15 is shown in FIG. 5. The engine 70 includes an oil pan 22 for reserving lubricating oil, a cylinder block 72 provided with cylinders (not shown), and a cylinder head 71. The cylinder head 71 supports camshafts 11 and 74, exhaust valves 75, and intake valves 12.

The engine 70 has combustion chambers connected with air intake passages and air exhaust passages (not shown). The intake valves 12 are located in the intake passages to control airflow supplied to the combustion chambers from the intake passages. The exhaust valves 75 are located in the exhaust passages to control exhaust airflow to the exhaust passages from the combustion chambers.

The cylinder block 72 rotatably supports a crankshaft 77. Tensioners 78, 79 are arranged at predetermined positions on the cylinder block 72. The cylinder head 71 rotatably supports the camshaft 11 so as to open and close the intake valves 12. The cylinder head 71 also rotatably supports the camshaft 74 so as to open and close the exhaust valves 75. The valve timing control mechanism 31 is provided at a distal end of the camshaft 11. The valve lift control mechanism 15 is provided between the valves 12 and the camshaft 11. Pulleys 80, 81, 31*a* are provided at distal ends of the crankshaft 77, the camshaft 74, and the valve timing control mechanism 31, respectively. A timing belt 39, which serves as a transmission device, is wound about the pulleys 80, 81, 31*a*. Tension is applied to the timing belt 39 by the tensioners 78, 79.

The rotation of the crankshaft 77 is transmitted to the camshafts 11, 74 by means of the timing belt 39 and the pulleys 80, 81, 31*a*. This rotates the camshafts 11, 74 synchronously with the crankshaft 77. The rotation of the camshafts 11, 74 selectively opens and closes the associated intake and exhaust valves 12, 75 in accordance with a predetermined timing.

Figure 1:
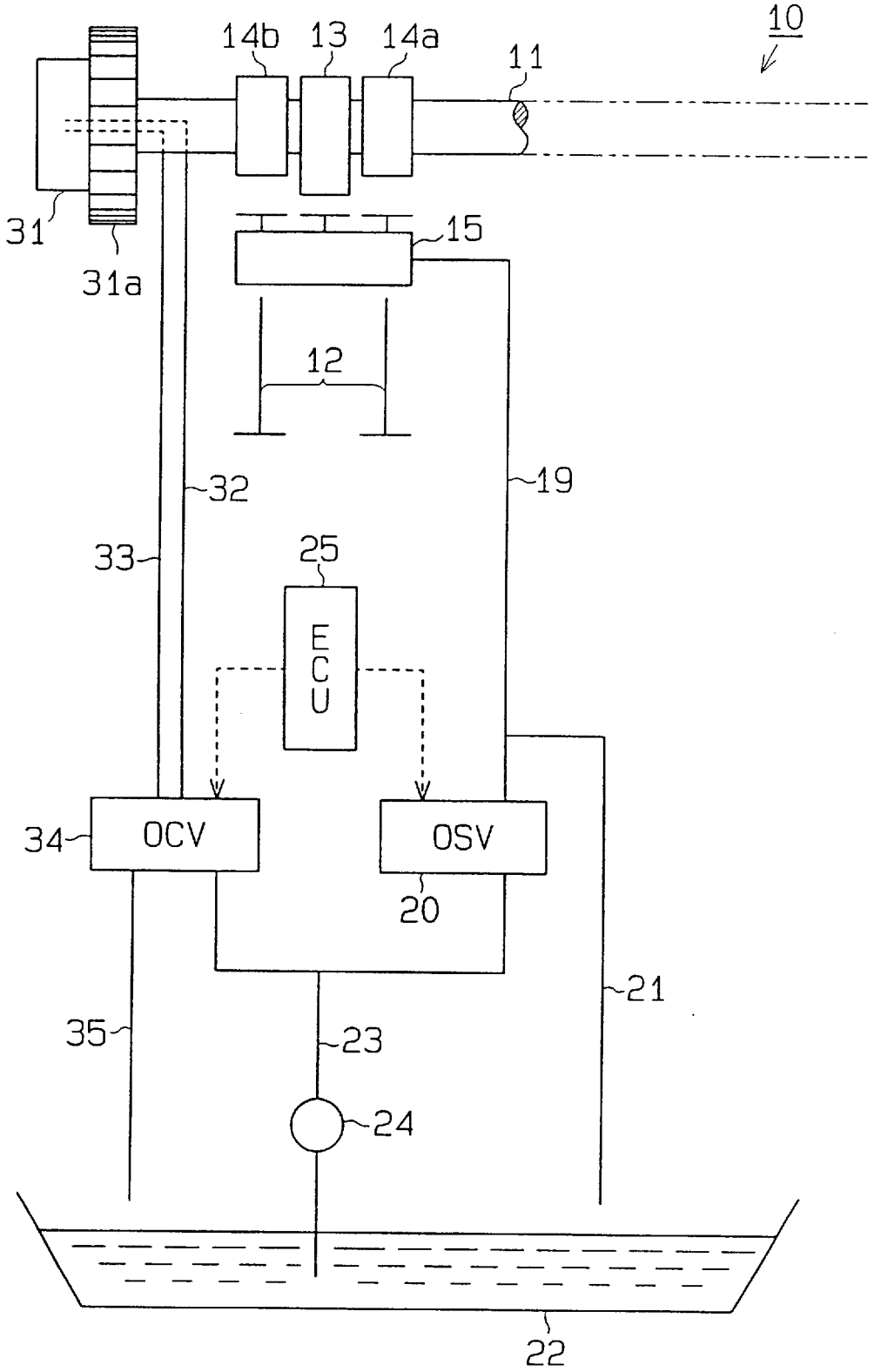
FIG. 1 is a block diagram showing the configuration of a valve performance controller according to a first embodiment of the present invention.
Figure 2:
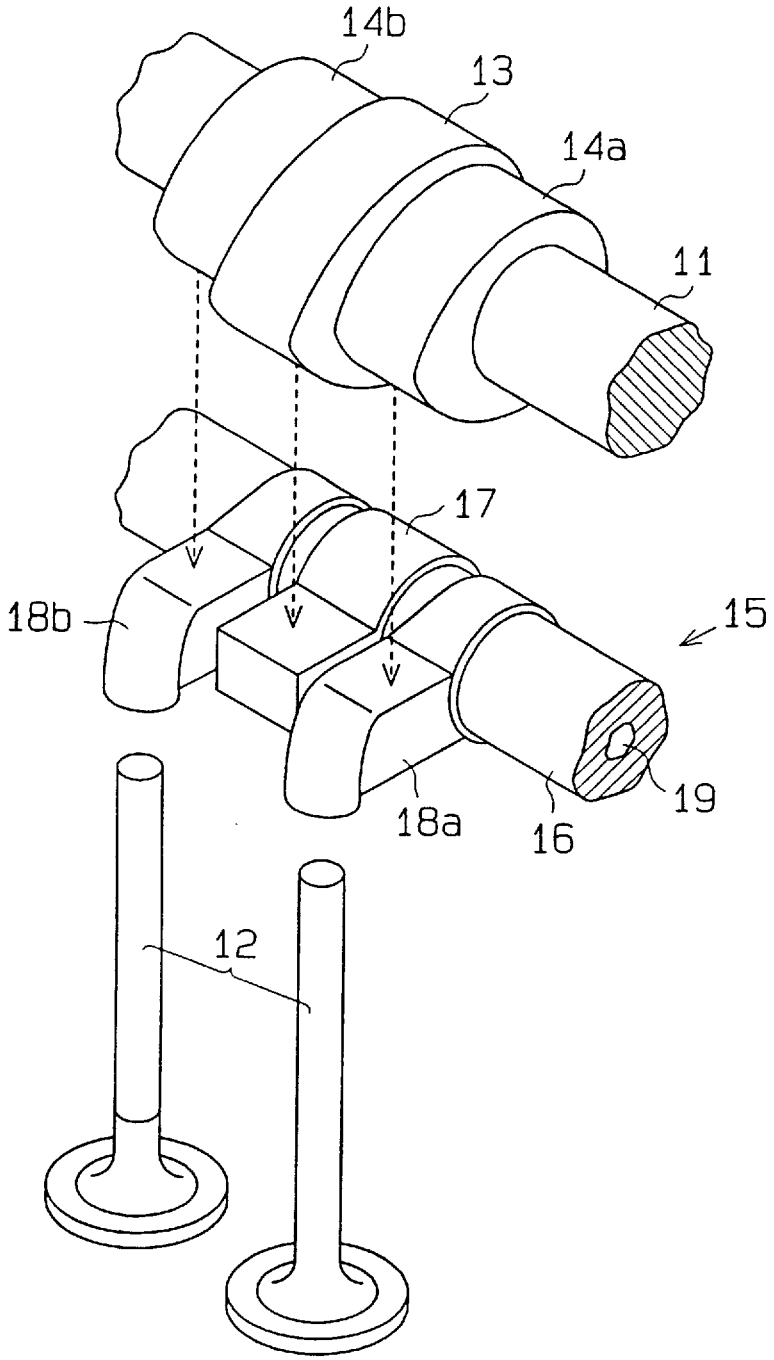
FIG. 2 is a perspective view showing a valve lift control mechanism.

As shown in FIGS. 1 and 2, the camshaft 11 is provided with a high speed cam 13 and low speed cams 14*a* and 14*b* for the purpose of opening and closing the intake valves 12. The high speed cam 13 is located between the low speed cams 14*a* and 14*b*. The high speed cam 13 has a cam profile different from that of the low speed cams 14*a* and 14*b* such that the lift of the valves 12 actuated by the high speed cam 13 is greater than that of the valves 12 actuated by the low speed cams 14*a* and 14*b*. Thus, the intake air volume of the engine 70 is decreased by opening and closing the valves 12 by means of the low speed cams 14*a* and 14*b* during low speed operation of the engine 70, whereas the intake air volume is increased by opening and closing the valves 12 by means of the high speed cam 13 during high speed operation of the engine 70.

The valve lift control mechanism 15 is provided between the valves 12 and the cams 13, 14*a*, and 14*b*. As shown in FIG. 2, the valve lift control mechanism 15 has a rocker shaft 16 parallel to the camshaft 11.

A high speed rocker arm 17 is provided on the rocker shaft 16 at a position corresponding to the high speed cam 13, and low speed rocker arms 18*a* and 18*b* are provided on the rocker shaft 16 at positions corresponding to the low speed cams 14*a* and 14*b*, respectively. The high speed rocker arm 17 is pivotable about the axis of the rocker shaft 16 relative to the rocker shaft 16. The low speed rocker arms 18*a* and 18*b* are fixed on the rocker shaft 16. Upper ends of the valves 12 are located under the distal ends of the low speed rocker arms 18*a* and 18*b*.

An oil feed-drain passage 19 extends through the rocker shaft 16 to the high speed rocker arm 17. As shown in FIG. 1, the oil feed-drain passage 19 is connected to an oil switching valve (OSV) 20 and an oil drain passage 21. The drain passage 21 runs to the oil pan 22 provided at the lower portion of an engine 70, so that oil drained from the oil drain passage 21 returns to the oil pan 22.

An oil feed passage 23 is connected to the OSV 20 and to the oil pan 22 via an oil pump 24. The oil pump 24 is connected to the crankshaft 77, and is thus driven as the crankshaft 77 rotates. The OSV 20 is actuated and controlled by an electronic control unit (ECU) 25.

Specifically, when the OSV 20 opens under control of the ECU 25, the driven oil pump 24 feeds oil from the oil pan 22 into the high speed rocker arm 17 (FIG. 2) via the oil feed passage 23, the OSV 20, and the oil feed-drain passage 19. When oil is fed into the high speed rocker arm 17, a coupler member (unillustrated) within the high speed rocker arm 17 moves to a position where the high speed rocker arm 17 and the low speed rocker arms 18*a* and 18*b* are coupled together. In this coupled state, the valves 12 are opened and closed by the high speed cam 13 via the high speed rocker arm 17 and the low speed rocker arms 18*a* and 18*b*.

When the OSV 20 is closed under control of the ECU 25, oil retained in the high speed rocker arm 17 drains into the oil pan 22 via the oil feed-drain passage 19 and the oil drain passage 21 shown in FIG. 1. When oil is drained from the high speed rocker arm 17, the coupler member moves to a position where the high speed rocker arm 17 and the low speed rocker arms 18*a* and 18*b* are uncoupled from each other. In this uncoupled state, the valves 12 are opened and closed by the low speed cams 14*a* and 14*b* via the low speed rocker arms 18*a* and 18*b*.

As shown in FIG. 1, the valve timing control mechanism 31 causes the camshaft 11 to lead or lag the crankshaft 77 to thereby vary the timing of actuating the valves 12. An advance control oil passage 32 and a delay control oil passage 33 are formed in the valve timing control mechanism 31. Oil is fed or drained through the advance control oil passage 32 and the delay control oil passage 33 under control of an oil control valve (OCV) 34.

The oil feed passage 23 is also connected to the OCV 34. In other words, the oil feed passage 23 branches into two passages downstream of the oil pump 24, and the individual oil feed passages 23 are connected to the OCV 34 and the OSV 20, respectively. An oil drain passage 35 is connected to the OCV 34, so that oil drained from the oil drain passage 35 returns to the oil pan 22. The OCV 34 is also actuated and controlled by the ECU 25.

Next, the structures of the valve timing control mechanism 31 and the OCV 34 will be described in detail.

Figure 3:
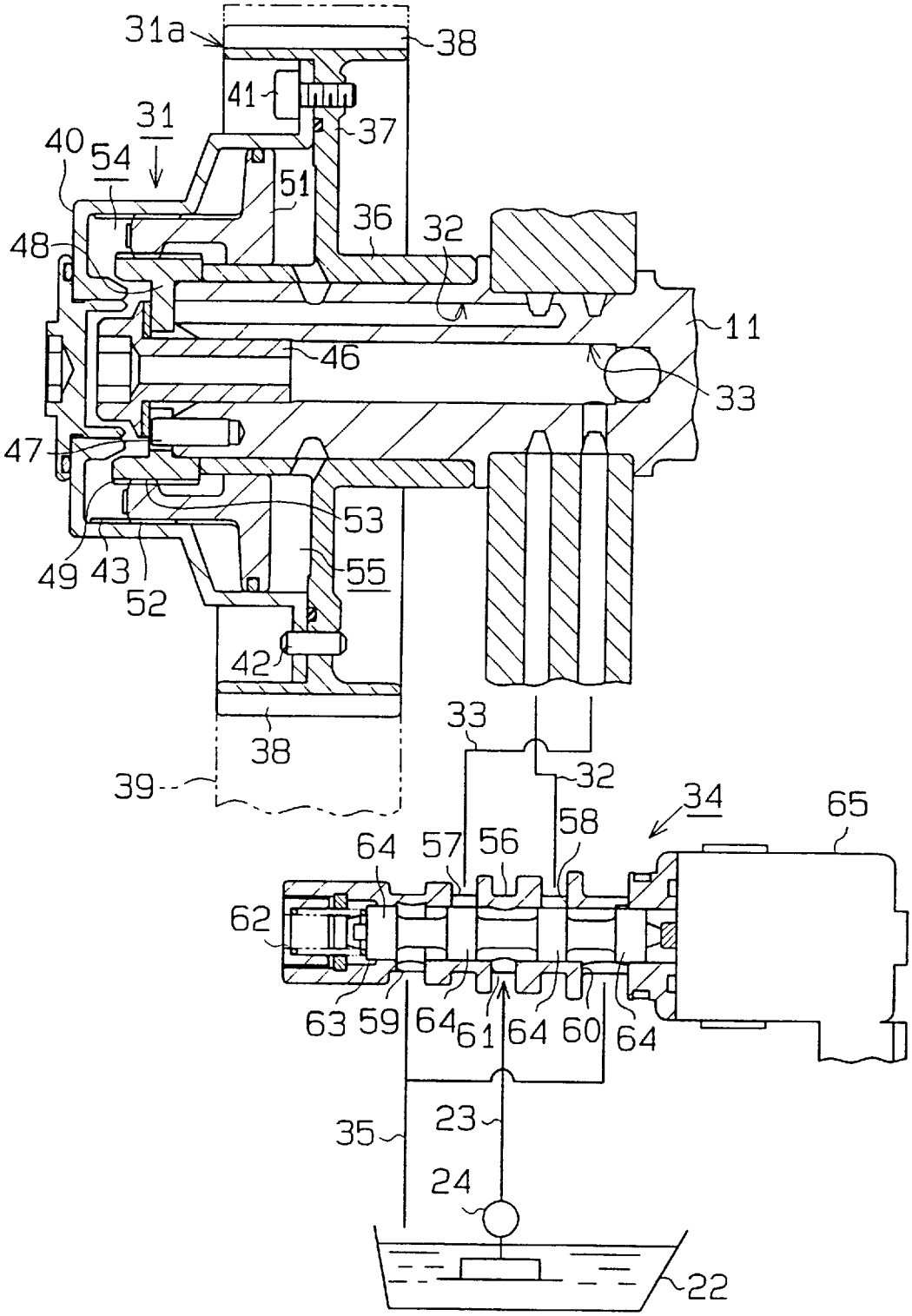
FIG. 3 is a sectional view showing a valve timing control mechanism and an oil control valve.

As shown in FIG. 3, the valve timing control mechanism 31 has the pulley 31*a*. The pulley 31*a* includes a cylindrical portion 36 through which the camshaft 11 penetrates, a disk portion 37 projecting from the periphery of the cylindrical portion 36, and a plurality of external teeth 38 formed on the periphery of the disk portion 37. The pulley 31*a* is connected to the crankshaft 77 via the timing belt 39 engaged with the external teeth 38. A cover 40 is fixed on the pulley 31*a* with a bolt 41 and a pin 42 to cover the end portion of the camshaft 11. A plurality of internal helical teeth 43 are circumferentially arranged on the inner wall of the cover 40 in correspondence with the end portion of the camshaft 11.

An inner cap 48 is fixed on the distal end of the camshaft 11 with a hollow bolt 46 and a pin 47. A plurality of external helical teeth 49 are circumferentially arranged on the periphery of the inner cap 48 such that the external teeth 49 face the internal teeth 43 of the cover 40. A cylindrical ring gear 51 is provided between the external teeth 49 and the internal teeth 43 and is movable in the axial direction of the camshaft 11. The ring gear 51 has helical teeth 52 and 53 engaged with the internal teeth 43 and the external teeth 49, respectively.

In the thus-structured valve timing control mechanism 31, when rotation of the crankshaft 77 driven by the engine 70 is transmitted to the pulley 31*a* via the timing belt 39, the pulley 31*a* and the camshaft 11 rotate in unison. As the camshaft 11 rotates, the valve 12 opens and closes as already mentioned. When the ring gear 51 moves toward the pulley 31*a* (rightward in FIG. 3), the helical teeth 52 and 53 of the ring gear 51 cause the relative rotational phase between the pulley 31*a* and the camshaft 11 to change in a direction causing the camshaft 11 to lag the crankshaft 77. As a result, the timing of actuating the valves 12 is delayed. By contrast, when the ring gear 51 moves toward the cover 40 (leftward in FIG. 3), the helical teeth 52 and 53 cause the relative rotational phase to change in a direction causing the camshaft 11 to lead the crankshaft 77. As a result, the timing of actuating the valves 12 is advanced.

Next the structural features of the valve timing control mechanism 31 associated with hydraulic movement of the ring gear 51 will be described.

The ring gear 51 divides the interior of the cover 40 into a delay hydraulic chamber 54 and an advance hydraulic chamber 55. The advance control oil passage 32 and the delay control oil passage 33 formed in the camshaft 11 correspond to the advance hydraulic chamber 55 and the delay hydraulic chamber 54, respectively. In other words, the advance control oil passage 32 communicates with the advance hydraulic chamber 55 through the cylindrical portion 36 of the pulley 31*a*, while the delay control oil passage 33 communicates with the delay hydraulic chamber 54 through the interior of the hollow bolt 46.

The OCV 34 includes a casing 56, which has first and second oil feed-drain ports 57 and 58, first and second oil drain ports 59 and 60, and an oil feed port 61. A spool 63 having four valve portions 64 is provided within the casing 56 such that a coil spring 62 and a solenoid 65 apply force A to the spool 63 in opposite directions, respectively.

Specifically, when the solenoid 65 is de-energized, the spool 63 is urged within the casing 56 toward the solenoid 65 (rightward in FIG. 3) by the elastic force of the coil spring 62. As a result, the first oil feed-drain port 57 and the first drain port 59 communicate with each other, and the second oil feed-drain port 58 and the oil feed port 61 communicate with each other. On the other hand, when the solenoid 65 is energized, the spool 63 is urged within the casing 56 toward the coil spring 62 (leftward in FIG. 3) against the elastic force of the coil spring 62. The second oil feed-drain port 58 and the second oil drain port 60 communicate with each other, and the first oil feed-drain port 57 and the oil feed port 61 communicate with each other. Further, when power to the solenoid 65 is controlled such that the spool 63 is positioned at the middle of the casing 56, the first and second oil feed-drain ports 57 and 58 are closed to inhibit oil from flowing through the first and second oil feed-drain ports 57 and 58. The advance control oil passage 32 and the delay control oil passage 33 are connected to the second oil feed-drain port 58 and the first oil feed-drain port 57, respectively; the oil feed passage 23 is connected to the oil feed port 61; and the oil drain passage 35 is connected to the first and second oil drain ports 59 and 60.

Figure 4:
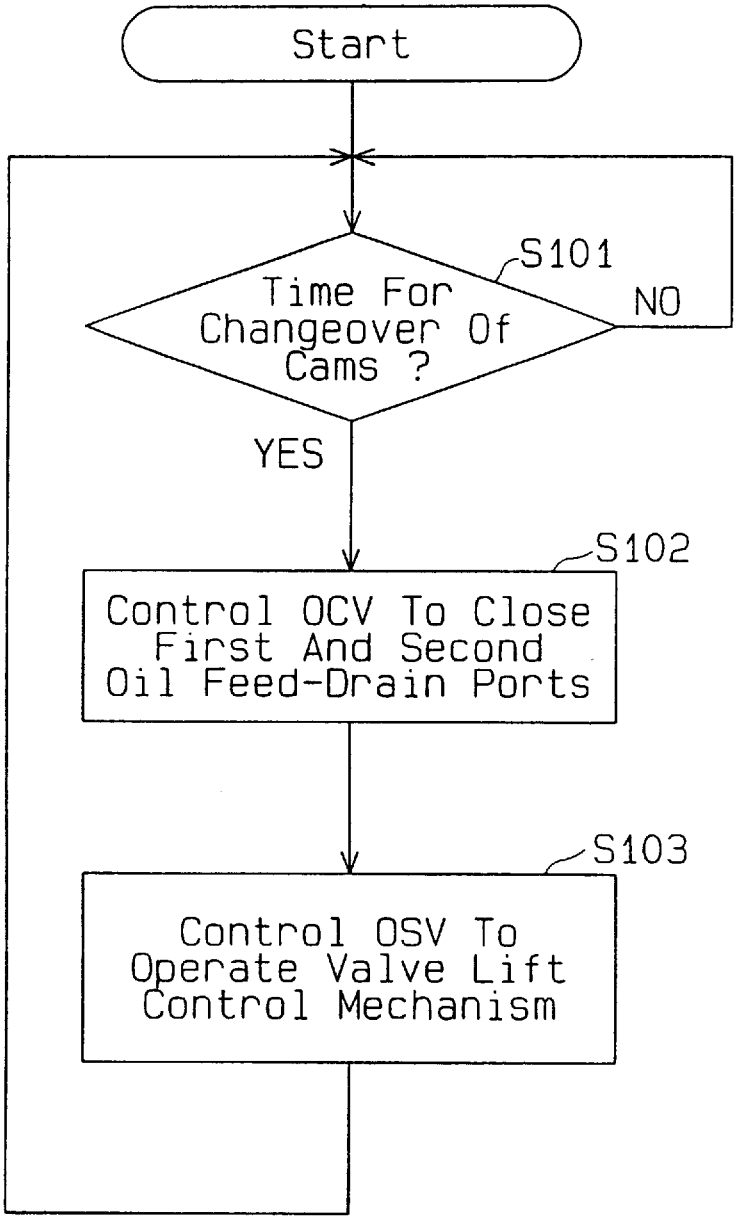
FIG. 4 is a flowchart illustrating valve lift control.

Next, operation of the valve performance controller 10 having the above-described structure will be described with reference to FIG. 4 and other relevant figures. FIG. 4 shows a valve lift control routine effected through the ECU 25.

In step S101 of the valve lift control routine, the ECU 25 determines whether to change the cams based on a signal received from an unillustrated sensor, which detects the rotational speed of the engine 70 or some indication of the engine speed. As already mentioned, whether to make a changeover of the cams depends on the current rotational speed of the engine 70. When the ECU 25 judges that it is not time to change the cams, step S101 is repeated. When the ECU 25 judges that it is time to change the cams, control proceeds to step S102.

When judging that it is time to change the cams, the ECU 25 controls the OCV 34 so as to close the first and second oil feed-drain ports 57 and 58, thereby shutting off the advance control oil passage 32 and the delay control oil passage 33. As a result of shutoff of the advance control oil passage 32 and the delay control oil passage 33, oil is prohibited from being fed to or drained from the delay hydraulic chamber 54 and the advance hydraulic chamber 55, so that oil is positively retained in the hydraulic chambers 54 and 55. While the valve timing control mechanism 31 is maintained in this state, the ECU 25 controls the OSV 20 in step S103 to actuate the valve lift control mechanism 15, thereby changing from the low speed cams 14*a* and 14*b* to the high speed cam 13, or changing from the high speed cam 13 to the low speed cams 14*a* and 14*b*.

As already mentioned, upon changing the cams to actuate the valves 12, the torque for rotating the camshaft 11 fluctuates due to the differences in cam profile and roughness of the contact surfaces between the high speed cam 13 and the low speed cams 14*a* and 14*b*.

In the valve performance controller 10, such torque fluctuations are appropriately dampened between the camshaft 11 and the pulley 31*a* by the oil retained in the delay hydraulic chamber 54 and the advance hydraulic chamber 55. Specifically, when such torque fluctuations are transmitted to the ring gear 51, a force is applied to the ring gear 51 in the axial direction of the camshaft 11. This force is attenuated by virtue of the dampening action of the oil retained in the hydraulic chambers 54 and 55.

When the advance control oil passage 32 and the delay control oil passage 33 are shut off by the OCV 34, all oil discharged from the oil pump 24 is fed to the valve lift control mechanism 15. Accordingly, even though the valve lift control mechanism 15 and the valve timing control mechanism 31 are hydraulically controlled through use of the single oil pump 24, the valve lift control mechanism 15 is reliably operated with no need to increase the capacity of the oil pump 24.

As described above, the present embodiment provides the following effects (a) to (c).

(a) Fluctuations in the driving torque of the camshaft 11 associated with changing the cams are dampened during transmission of the fluctuations from the camshaft 11 to the pulley 31*a* by oil retained in the delay hydraulic chamber 54 and the advance hydraulic chamber 55. Accordingly, the impact of such fluctuations on the timing belt 39 is reduced.

(b) Upon changing the cams, the first and second oil feed-drain ports 57 and 58 of the OCV 34 are closed to shut off the advance control oil passage 32 and the delay control oil passage 33. Accordingly, oil is fully retained in the delay hydraulic chamber 54 and the advance hydraulic chamber 55 very easily and efficiently.

(c) Upon changing the cams, the advance control oil passage 32 and the delay control oil passage 33 are shut off, so that all oil discharged from the oil pump 24 is fed to the valve lift control mechanism 15. Accordingly, even though the valve timing control mechanism 31 and the valve lift control mechanism 15 are hydraulically controlled through use of the single oil pump 24, the valve lift control mechanism 15 is reliably operated with no need to increase the capacity of the oil pump 24. Thus, the power loss of the engine 70 is minimized. That is, an increase in the capacity of the oil pump 24 or installation of an additional oil pump 24 is not necessary.

The present invention may also be embodied, for example, in the following modified forms.

(1) In the illustrated embodiment, the valves 12 are opened and closed by means of either the high speed cam 13 or the low speed cams 14*a* and 14*b*. However, three or more kinds of cams may be employed, thereby expanding the range of selection of cams used for opening and closing the valves 12.

Figure 6:
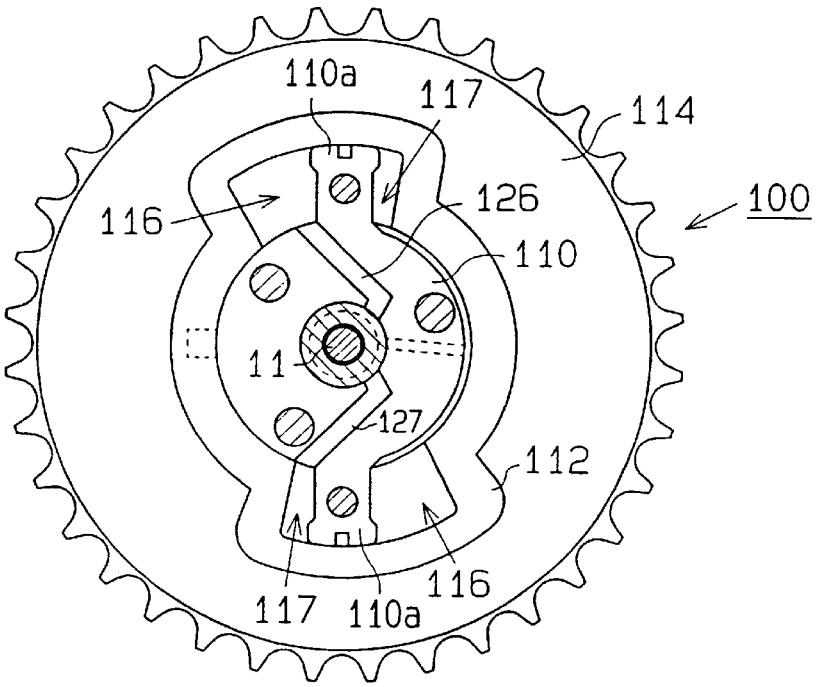
FIG. 6 is a partial enlarged cross-sectional view showing a second embodiment of a valve timing control mechanism according to the present invention.

(2) The reciprocating type valve timing control mechanism 31 of the illustrated embodiment may be replaced by a vane type control mechanism. For example, a vane type valve timing control mechanism 100 as shown in FIG. 6 may be employed. A vane type valve timing control mechanism like that shown in FIG. 6 is described in detail in U.S. Pat. No. 5,107,804, which is incorporated herein by reference.

The vane type valve timing control mechanism 100, which is fixed to the end of the camshaft 11, has a vaned rotor 110, a housing 112 surrounding the rotor 110, and a sprocket 114. The rotor 110 has a pair of vanes 110*a*. The sprocket 114 and the housing 112 are integral and are rotatable with respect to the camshaft 11 and the rotor 110. Further, this valve timing control mechanism 100 has chambers 116, 117 on each side of the vanes 110*a*, the chamber 116, 117 being formed by cooperation between the vanes 110*a* on the rotor 110 and the housing 112. The sprocket 114 is connected to the crankshaft 77 with a timing chain (not shown), which serves as a transmission device. By selectively applying hydraulic pressure to the chambers 116, 117 through passage 126, 127, the camshaft 11 is rotated clockwise or counterclockwise with respect to the sprocket 114.

In the vane type valve timing control mechanism, the chambers 116, 117 are provided on opposite sides of each vane 110*a*, and oil is retained in the chambers 116, 117 to provide an effect similar to that of the present embodiment.

(3) In the illustrated embodiment, the first and second oil feed-drain ports 57 and 58 are closed during cam changing. However, the OCV 34 may have a structure such that the first and second oil feed-drain ports 57 and 58 communicate with the oil feed port 61 during the cam changing operation. In this case, the delay hydraulic chamber 54 and the advance hydraulic chamber 55 are continuously fed with oil during cam changes, so that oil is retained in the hydraulic chambers 54 and 55, thus appropriately maintaining the damping effect of oil in the chambers 54 and 55.

(4) In the illustrated embodiment, the single oil pump 24 is used to feed oil to both the valve lift control mechanism 15 and the valve timing control mechanism 31. However, separate oil pumps may be employed to feed oil to the respective mechanisms 15 and 31. In this case, even when one oil pump fails, either the valve lift control mechanism 15 or the valve timing control mechanism 31 can be operated with the other oil pump. Accordingly, one oil pump failure dose not disable both mechanisms 15 and 31.

(5) In the illustrated embodiment, the oil pump 24 is connected to a crankshaft 77 to drive the oil pump 24 through rotation of the crankshaft 77. However, the present invention is not so limited. For example, an electric motor may be provided to drive the oil pump 24, so that the oil pump 24 is driven regardless of whether the crankshaft 77 is rotating or not.

(6) In the illustrated embodiment, the valve lift control mechanism 15 is hydraulically actuated. However, the valve lift control mechanism 15 may be actuated by other than hydraulic means, for example, by electric means.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling valve performance in an engine having a combustion chamber connected with an air intake passage and an air exhaust passage, an intake valve located in the intake passage to control airflow supplied to the combustion chamber from the intake passage, and an exhaust valve located in the exhaust passage to control exhaust airflow to the exhaust passage from the combustion chamber, wherein each of said valves is controlled to adjust airflow passing therethrough with a variable valve lift amount and a variable valve timing, said apparatus comprising:

a camshaft provided with a plurality of cams of different shapes for actuating at least one of the valves;

a first mechanism for selecting at least one cam for actuating the actuated valve to alter a lift amount of the actuated valve;

a second mechanism for controlling the valve timing, said second mechanism being provided on the camshaft, wherein said second mechanism has a rotary member, a movable member, and first and second hydraulic chambers, wherein said movable member couples said rotary member with said camshaft, wherein said movable member moves to change the relative rotational phase between said rotary member and said camshaft, wherein said first and second hydraulic chambers are provided respectively on opposite sides of said movable member, and wherein said chambers control movement of said movable member with hydraulic pressure;

a transmission device for transmitting torque from the engine to the rotary member;

means for altering the hydraulic pressure in the first and second chambers, said altering means selectively supplying hydraulic fluid to and draining hydraulic fluid from said first and second hydraulic chambers; and means for controlling said altering means to charge and retain hydraulic fluid in the chambers during changing of the operative cam by said first mechanism.

2. The apparatus according to claim 1, wherein said first and second hydraulic chambers communicate with first and second oil passages, respectively, wherein said altering means includes a control valve for controlling oil flow in the first and second oil passages, and wherein said control means controls said control valve so as to close said first and second oil passages when said first mechanism changes the operative cam.

3. The apparatus according to claim 2, wherein said first mechanism is hydraulically actuated, and wherein said altering means includes an oil pump for feeding oil to said first mechanism and said first and second hydraulic chambers.

4. The apparatus according to claim 3, wherein said oil pump is driven by said engine.

5. The apparatus according to claim 1, wherein said movable member is axially movable relative to said rotary member and said camshaft, and wherein said movable member is coupled to said rotary member and said camshaft through gear engagement, such that when said movable member is axially moved, the relative rotational phase between said rotary member and said camshaft changes.

6. The apparatus according to claim 1, wherein said movable member is a vaned rotor that is connected to said camshaft and is rotatable relative to said rotary member.

7. An apparatus for controlling valve performance in an engine having a combustion chamber connected with an air intake passage and an air exhaust passage, an intake valve located in the intake passage to control airflow supplied to the combustion chamber from the intake passage, and an exhaust valve located in the exhaust passage to control exhaust airflow to the exhaust passage from the combustion chamber, wherein each of said valves is controlled to adjust airflow passing therethrough with a variable valve lift amount and a variable valve timing, said apparatus comprising:

a camshaft provided with a plurality of cams of different shapes for actuating at least one of the valves;

a first mechanism for selecting at least one cam for actuating the actuated valve to alter a lift amount of the actuated valve;

a second mechanism for controlling the valve timing, said second mechanism being provided on the camshaft, wherein said second mechanism has a rotary member, a movable member, and first and second hydraulic chambers, wherein said movable member couples said rotary member with said camshaft, wherein said movable member moves to change the relative rotational phase between said rotary member and said camshaft, wherein said first and second hydraulic chambers are provided respectively on opposite sides of said movable member, and wherein said chambers control movement of said movable member with hydraulic pressure;

a transmission device for transmitting torque from the engine to the rotary member;

first and second oil passages communicated with said first and second hydraulic chambers, respectively;

an oil pump for feeding oil to said first and second hydraulic chambers via said first and second oil passages;

a control valve for controlling oil flow in the first and second oil passages, said control valve selectively supplying oil to and draining oil from said first and second hydraulic chambers; and means for controlling said control valve so as to close said first and second oil passages to charge and retain oil in the chambers during changing of the operative cam by said first mechanism.

8. The apparatus according to claim 7, wherein said movable member is axially movable relative to said rotary member and said camshaft, and wherein said movable member is coupled to said rotary member and said camshaft through gear engagement, such that when said movable member is axially moved, the relative rotational phase between said rotary member and said camshaft changes.

9. The apparatus according to claim 8, wherein said rotary member is composed of a pulley and a pulley cover, wherein said movable member is a ring gear, which has external helical teeth engaging with internal helical teeth formed on the inner surface of said pulley cover and internal helical teeth engaging with external helical teeth formed on an inner cap attached to said camshaft.

10. The apparatus according to claim 9, wherein said first mechanism is hydraulically actuated, and wherein said oil pump feeds oil to said first mechanism and said first and second hydraulic chambers.

11. The apparatus according to claim 10, wherein said oil pump is driven by said engine.

12. The apparatus according to claim 7, wherein said movable member is a vaned rotor that is connected to said camshaft and is rotatable relative to said rotary member.

* * * * *